United States Patent [19]

Kramer

[11] 4,195,439

[45] Apr. 1, 1980

[54] TOY FLYING OBJECT

[76] Inventor: Dale C. Kramer, 39 Charles St., Port Colborne, Ontario, Canada, L3K 3R3

[21] Appl. No.: 896,097

[22] Filed: Apr. 13, 1978

[51] Int. Cl.[2] ..... A63H 27/00

[52] U.S. Cl. ..... 46/79; 244/35 R

[58] Field of Search ..... 46/79, 80; 273/106 D, 273/95 B; 244/35 R, 35 A, 16, 153 R, 154

[56] References Cited

U.S. PATENT DOCUMENTS

| | | | |
|---|---|---|---|
| D. 162,707 | 4/1951 | Benson | 46/79 |
| 1,413,258 | 4/1922 | Christmas | 244/35 R |
| 1,470,017 | 10/1923 | Lougheed | 244/35 R |
| 1,486,463 | 3/1924 | Short | 46/79 |
| 1,632,641 | 6/1927 | Bauer | 244/35 R |
| 1,786,472 | 12/1930 | Yates | 244/35 R |
| 2,004,543 | 6/1935 | Warren | 46/79 |
| 4,116,407 | 9/1978 | Murray | 244/16 |

FOREIGN PATENT DOCUMENTS

| | | | |
|---|---|---|---|
| 553683 | 6/1932 | Fed. Rep. of Germany | 46/79 |
| 492383 | 7/1919 | France | 244/35 R |
| 20095 | of 1908 | United Kingdom | 46/79 |
| 582206 | 11/1946 | United Kingdom | 244/35 R |

*Primary Examiner*—Louis G. Mancene
*Assistant Examiner*—Paul J. Hirsch
*Attorney, Agent, or Firm*—Sim & McBurney

[57] ABSTRACT

A toy flying object consists of a single wing which is shaped and weighted to provide aerodynamic capabilities. The single wing structure is readily and simply manufactured.

10 Claims, 4 Drawing Figures

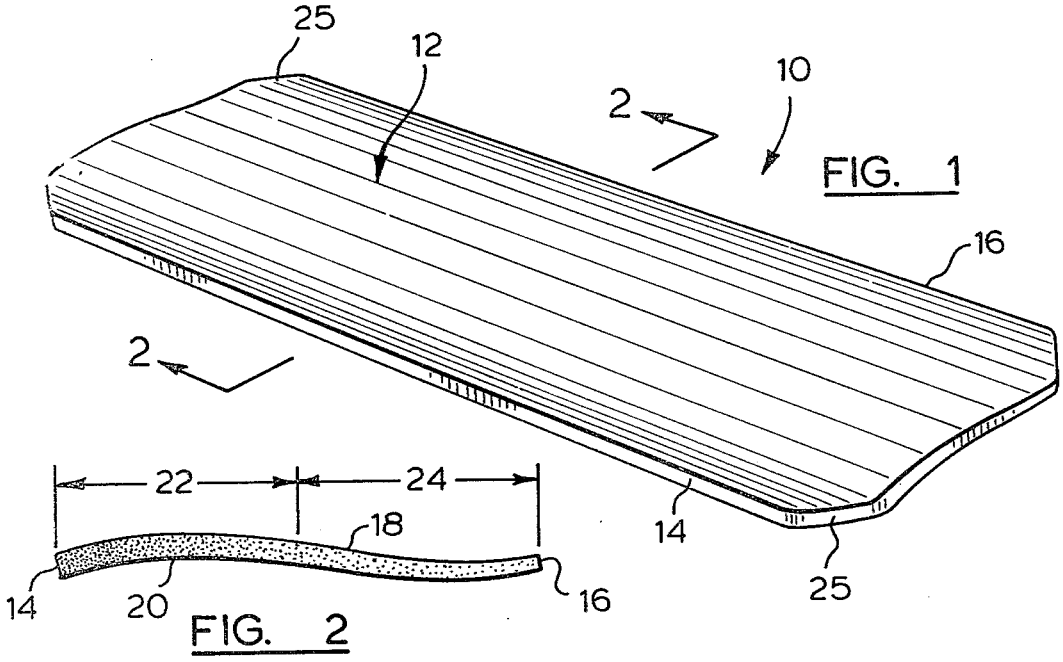
FIG. 1
FIG. 2
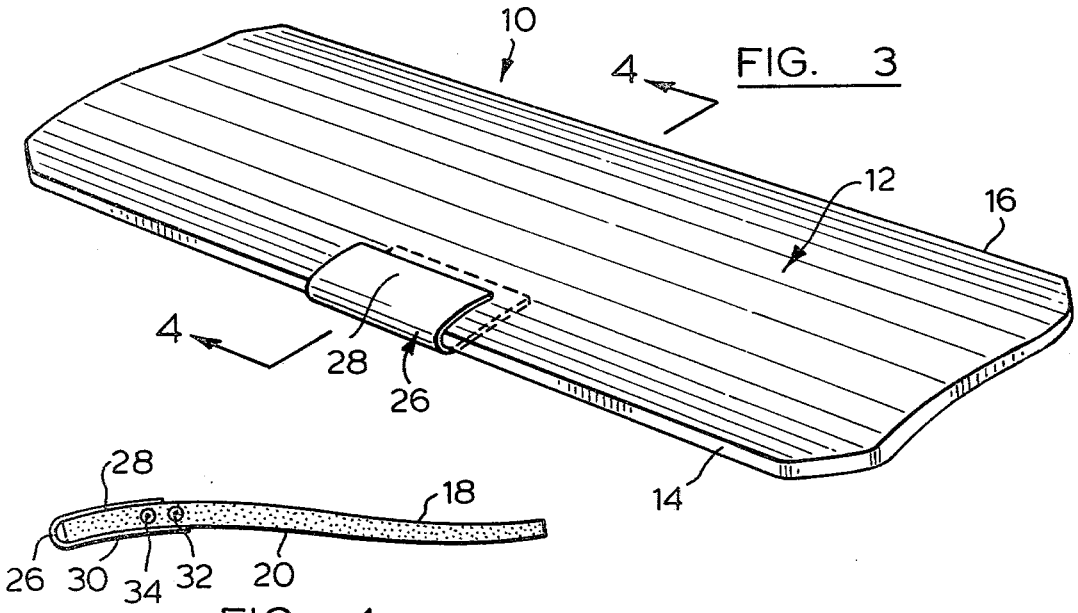
FIG. 3
FIG. 4

TOY FLYING OBJECT

FIELD OF INVENTION

The present invention relates to toy flying objects of the glider type.

BACKGROUND TO THE INVENTION

There have been many prior suggestions to provide toy flying objects of the glider type, that is, those which do not possess an on-board propulsion means and normally get their motive power from being thrown or projected by human hand. Generally, these flying objects have attempted to simulate commercial aircraft in providing a fuselage, two forward wings, a tail and rear wings. The flying characteristics of such flying objects require them to follow a generally straight line path.

SUMMARY OF INVENTION

The present invention is directed to a toy flying object which is considerably simplified with respect to such prior art structures and yet is capable of flying and providing considerable enjoyment.

The toy flying object of this invention consists of a single wing which is shaped and weighted to provide aerodynamic capabilities and certain flying characteristics. The single-wing structure provided by the invention is relatively simple to manufacture and conventional procedures for forming shaped objects, such as, molding, extruding or cutting from a block of material, may be used.

BRIEF DESCRIPTION OF DRAWINGS

FIG. 1 is a front perspective view from above of a single wing flying object provided in accordance with a preferred embodiment of this invention;

FIG. 2 is a sectional view taken along line 2—2 of FIG. 1;

FIG. 3 is a front perspective view from above of a flying object provided in accordance with a second preferred embodiment of this invention; and FIG. 4 is a sectional view taken along line 4—4 of FIG. 3.

DESCRIPTION OF PREFERRED EMBODIMENTS

Referring to the drawings and first to the embodiment of FIGS. 1 to 2, a single wing flying object 10, provided in accordance with one preferred embodiment of the invention consists of a generally rectangularly-shaped body 12 formed of foamed polymeric material and having a forward edge 14 and a rearward edge 16. The body 12 has generally smooth continuous upper and lower surfaces 18 and 20 and the body 12 tapers in thickness between the forward edge 14 and the rearward edge 16, as seen in FIG. 2.

Any desired decorative or informative pattern or printing may be provided in any convenient manner on either or both the upper and lower surfaces 18 and 20.

The tapering of the thickness of the body 12 between the forward and rearward edges 14 and 16 represents a preferred structure, and a uniform thickness may be adopted, if desired. The body 12 has only a thin section between the upper and lower surfaces 18 and 20.

The body 12 is weighted towards the forward edge 14, and in the embodiment of FIGS. 1 and 2 this is achieved by providing a higher density material adjacent the forward edge 14 than elsewhere in the body 12.

The body 12 undulates between the forward edge 14 and the rearward edge 16. The width or distance between the forward edge 14 and the rearward edge 16 may be considered as being made up of two integral areas.

A first area 22 extending from the forward edge 14 to the approximate midpoint of the width has a generally convexo-concave cross section with respect to the upper and lower surfaces 18 and 20 and exerts lift on the wing. A second area 24 extending from rearward edge 16 to the approximate mid-point of the width has a generally concavo-convex cross section with respect to the upper and lower surfaces 18 and 20 and exerts drag on the wing.

The respective lift (vertical) and drag (horizontal) forces exerted on the flying object 10 by the cross-sectional shaping of the body 12 determine to some extent the overall flying characteristics and these are discussed in more detail below.

The corners 25 of the body 12 are cut away to remove sharp protrusions and for decorative effect. Any desired wing tip configuration may be provided within the generally rectangular shape of the body 12.

Turning now to consideration of the embodiment of FIGS. 3 and 4, the single wing flying object 10 illustrated therein comprises the same component parts as the flying object illustrated in FIGS. 1 and 2 and the same reference numerals are used to designate the same parts. In this embodiment, however, weighting is provided by one or more clips 26, typically metal clips, mounted on the front edge 14 of the body 12, the body 12 being formed of substantially uniformly dense material.

In the illustrated embodiment, a single clip 26 is provided positioned approximately in the middle of the length of the front edge 14 and has a generally U-shaped structure in which one leg 28 is shorter than the other leg 30. The latter relative sizing of the legs 28 and 30 permits ready mounting of the clip 26 on the front edge 14. Both legs may be equally dimensioned, if desired, although this structure is less preferred.

More than one clip 26 may be provided, if desired, to increase the weight on the forward edge. This increase in weight has the effect of increasing the flying speed of the flying object 10. The increase in weight also may be achieved by using a single clip 26 constructed of heavier material or a single clip 26 having a greater longitudinal dimension.

When a plurality of clips 26 is used, the individual clips may abut each other or may be spaced apart, generally equally with respect to the mid-point of the length of the front edge 14.

Experience has shown that concentration of the weight towards the mid-point of the length of front edge 14 improves the flying characteristics as compared with substantially even weight distribution along the front edge, so that the embodiment of FIGS. 3 and 4 represents the preferred embodiment of the invention.

While the clip or clips 26 are normally positioned symmetrically with respect to the midpoint of the length of the front edge 14 to provide a balance about the lateral axis of the body 12, it is possible to offset the clip or clips 26 from this midpoint and thereby vary the flying characteristics of the wing.

The smooth continuous upper and lower surfaces 18 and 20 of the body 12 uninterrupted by vertical stabilizers or the like provides the flying object 10 with close to neutral lateral stability, that is, the flying object will retain a given flight path unless disturbed from that flight path, such as, by wind currents, and, if disturbed from the given flight path, will assume a new flight path corresponding to the disturbance and will not attempt to return to the initial flight path or diverge from the new flight path unless again disturbed.

The substantially neutral lateral stability of the flying object 10 of this invention contrasts markedly with the static lateral stability of those toy flying objects which are simulated models of commercial aircraft wherein the flying object is designed to retain a given flight path even if disturbed therefrom. Such static lateral stability is achieved therein by the use of one or more vertical stabilizers, such as, a vertical tail structure. Owing to the substantially neutral lateral stability, the flying characteristics of the flying object 10 of this invention are more pleasing and interesting than those with static lateral stability.

As mentioned above, the convexo-concave portion 22 of the body 12 imparts lift to the wing while the concavo-convex portion 24 imparts drag on the wing motion. Both effects are important, the lift being required for flight and the drag being required for longitudinal stability, that is, a stability about the longitudinal axis of the body 12 which maintains the attitude of the flying object 10 and inhibits stalling.

The shaping of the convexo-concave portion 22 and the concavo-convex portion 24 may vary widely. It is important, however, for longitudinal stability of the flying object to provide shapes such that the aerodynamic centre (a.c.) 32 of the flying object 10 is located between about 20 to about 25% of the straight line distance from the front edge 14 to the rear edge 16. The aerodynamic centre of the flying object 10 is the point about which when the drag and lift force moments exerted on the flying object 10 are resolved, the net moment is constant for all angles of attack.

The weighting of the flying object 10 towards its front edge 14, provided by higher density material in the embodiment of FIG. 1, or by one or more weights 34 in the embodiment of FIG. 3, is sufficient to ensure that the centre of gravity (c.g.) 34 of the wing is located forward of the aerodynamic centre 32 of the flying object 10, preferably between the aerodynamic centre 32 and the front edge 14.

DESCRIPTION OF ALTERNATIVE EMBODIMENTS

While the above description of the preferred embodiments of the invention in FIGS. 1 to 4 is made with respect to a generally rectangular body 12 and represents the current best mode known to the applicant, the principles of construction of the flight object of the invention are applicable to single wing flying objects having various alternative shapes, and are considered to form part thereof.

Provided that the proper relationship of weighting and cross-sectional shape is maintained, as described in detail above, it is possible to provide the single wing flying object in a round shape, an oval shape, a parabolic shape, a triangular shape, or a slightly swept back or slightly swept forward shape.

Further, while the front and rear edges 14, 16 are straight lines giving the body 12 its generally flat shape, the body 12 may also have a dihedral or anhedral shape, if desired.

The particular chosen shape will exhibit its own peculiarities with respect to flying characteristics and, overall, the applicant prefers the generally rectangular shape illustrated in the accompanying drawings.

SUMMARY

The present invention, therefore, provides a unique toy flying object which has a single wing configuration. Modifications are possible within the scope of this invention.

What I claim is:

1. A toy free flight flying object which is substantially non-flexible in flight and consists essentially of a single generally planar element without stabilizing members upstanding from said plane, whereby said element has close to neutral lateral stability, said planar element having forward and rearward effective parallel edges and generally continuous smooth upper and lower surfaces, said planar element being substantially symmetrical about a centre line extending between said forward and rearward edges and lying within a rectangle, said planar element having a cross-sectional shape wherein at least the upper surface thereof undulates between said forward and rearward edges with a convex upper surface towards the forward edge and a concave upper surface towards the rearward edge, said cross-sectional shape establishing an aerodynamic centre of said planar element located sufficiently close to said forward edge to impart longitudinal stability to said planar element, said planar element being weighted towards said forward edge thereof to establish a centre of gravity of said flying object which is located forwardly of said aerodynamic centre.

2. The flying object of claim 1, wherein said cross-sectional shape of said planar element also includes a lower surface which undulates between the forward and rearward edges with a concave lower surface corresponding to said convex upper surface and a convex lower surface corresponding to said concave upper surface.

3. The flying object of claim 2, wherein said planar element tapers in thickness between said forward edge and said rearward edge.

4. The flying object of claim 1, wherein said planar element is weighted by at least one generally U-shaped clip member mounted on the forward edge of said planar element.

5. A toy free flight flying object which is substantially non-flexible in flight and consisting essentially of an integrally-formed substantially rigid generally rectangular and planar element having a forward longitudinal edge and a rearward longitudinal edge and generally continuous smooth upper and lower surfaces without stabilizing members upstanding therefrom, whereby said element has substantially neutral lateral stability, said element having a thin cross-sectional dimension and a cross-sectional shape which undulates between said forward edge and said rearward edge with convexo-concave upper and lower surfaces towards the forward edge and concavo-convex upper and lower surfaces towards the rearward edge, said cross-sectional shape imparting longitudinal stability to said element and establishing an aerodynamic centre of said body members located less than about 25% of the linear distance from said forward edge to said rearward edge, said element member being weighted towards said forward edge thereof to establish a centre of gravity of said flying object which is located forwardly of said aerodynamic centre.

6. The flying object of claim 5, wherein said convexo-concave upper and lower surfaces extend substantially from the forward edge of said element to approximately the midpoint of the distance between said forward and rearward edges and said concavo-convex upper and lower surfaces extend substantially from said rearward edge to the termination of said convexo-concave upper and lower surfaces.

7. The flying object of claim 6, wherein said centre of gravity is located between said aerodynamic centre and said forward edge.

8. The flying object of claim 7, wherein said element is weighted by at least one U-shaped clip member located on the forward edge of said element with the legs thereof engaging the upper and lower surfaces.

9. The flying object of claim 8, wherein one of the legs of said clip member is shorter in length than the other such leg.

10. The flying object of claim 8, wherein said at least one clip member is symmetrically arranged on said forward edge with respect to the mid-point of the length of said forward edge.

* * * * *